US005140930A

United States Patent [19]

Lund

[11] Patent Number: 5,140,930

[45] Date of Patent: Aug. 25, 1992

[54] WATER CRAFT

[75] Inventor: John A. Lund, Queensland, Australia

[73] Assignee: Rhoda Stolk and Stolkraft Pty. Ltd., Australia

[21] Appl. No.: 758,185

[22] PCT Filed: Apr. 28, 1988

[86] PCT No.: PCT/AU88/00121

§ 371 Date: Dec. 29, 1989

§ 102(e) Date: Dec. 19, 1989

[87] PCT Pub. No.: WO88/08387

PCT Pub. Date: Nov. 3, 1988

Related U.S. Application Data

[63] Continuation of Ser. No. 444,166, Dec. 29, 1989, abandoned.

[30] Foreign Application Priority Data

Apr. 30, 1987 [AU] Australia ..... PI1685/87

[51] Int. Cl.[5] ..... B63B 1/38

[52] U.S. Cl. ..... 114/291; 114/290

[58] Field of Search ..... 114/56, 61, 62, 271, 114/283, 288–291; D12/312; 440/68–70

[56] References Cited

U.S. PATENT DOCUMENTS

| | | | |
|---|---|---|---|
| 3,469,549 | 9/1969 | Roe | 114/291 |
| 3,625,173 | 12/1971 | Mitton | 114/291 |
| 3,885,514 | 5/1975 | Lavenborg | 114/61 |
| 3,902,445 | 9/1975 | Stolk | 114/291 |

*Primary Examiner*—Edwin L. Swinehart

*Attorney, Agent, or Firm*—Sughrue, Mion, Zinn Macpeak & Seas

[57] ABSTRACT

A planing hull of a water craft including side keels and a center keep. A downwardly open chamber is defined rearwardly of the center keel and is flanked on either side by the side keels. The chamber confines a cushion of air which supports the hull in the planing mode, air supply to the chamber being wholly via the underside of the hull by being channelled between the keels without the use of air vents which open into the chamber. The absence of air vents provides improved drag at medium and low speeds.

12 Claims, 3 Drawing Sheets

WATER CRAFT

This is a continuation of application Ser. No. 07/444,166 filed Dec. 29, 1989, now abandoned.

The present invention relates to a water craft.

There is disclosed in Australian Patent Specification No. 456,662 a water craft comprising a planing hull. The hull includes a rear pressure-retaining chamber or tunnel aft of a transverse step in the hull and extending to the transom. Air intakes in the forward part of the hull communicate with the chamber via air vents in the transverse step whereby the forward motion of the craft causes air to be charged via the vents into the chamber to form an air cushion which supports the hull in a planing mode. Hulls which utilize a supporting air cushion in this manner are generally known as "ground effect" machines.

Although this previously proposed hull has been found to work satisfactorily at high planing speeds by creating low flow resistance or drag, at low to medium speeds, for example up to 20–25 knots, the hull generates higher drag than in conventional planing hulls which do not utilise the air cushion or "ground effect" principal.

An object of the invention is to provide a planing hull of the ground effect type which has improved drag characteristics at low to medium speeds.

According to one aspect of the present invention, there is provided a planing hull for a water craft, comprising side and centre keels, the centre keel terminating rearwardly at a downwardly open chamber flanked at each side by the side keels, said chamber serving to confine a cushion of air which supports the hull in the planing mode, supply of air to the chamber being wholly via the underside of the hull by being channelled between the centre keel and the side keels.

Preferably, the upper wall of the chamber is plain and substantially parallel to the tips of the keels.

An embodiment of the invention will now be described by way of example only with reference to the accompanying drawings in which.

Figure 1:
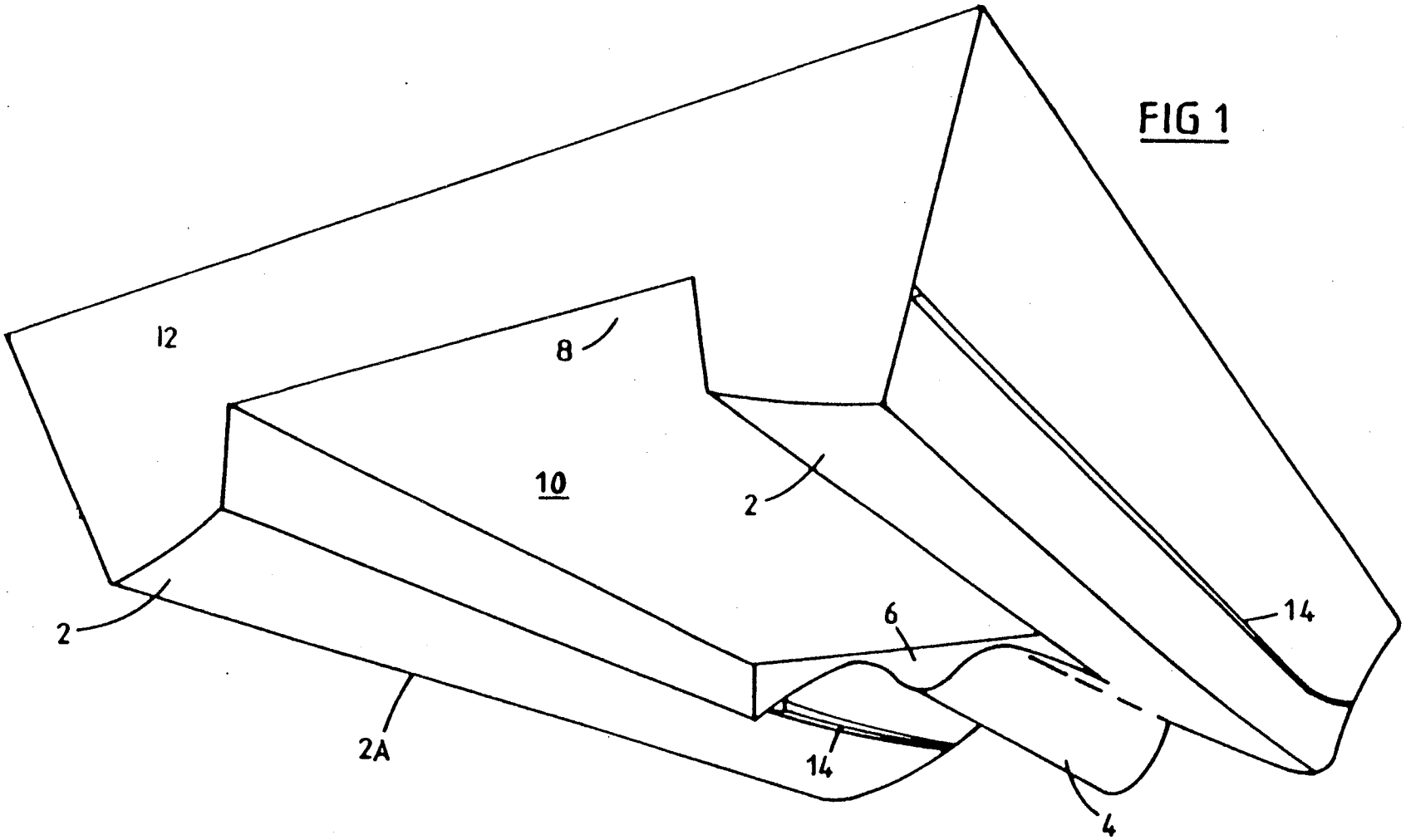
FIG. 1 is a perspective view of a planing hull in accordance with the invention.

The planing hull shown in the drawings is generally similar to that of Patent Specification 456,662 in that it comprises, at its underside, a chamber or tunnel to enclose a cushion of air which supports the hull in its planing mode.

Figure 2:
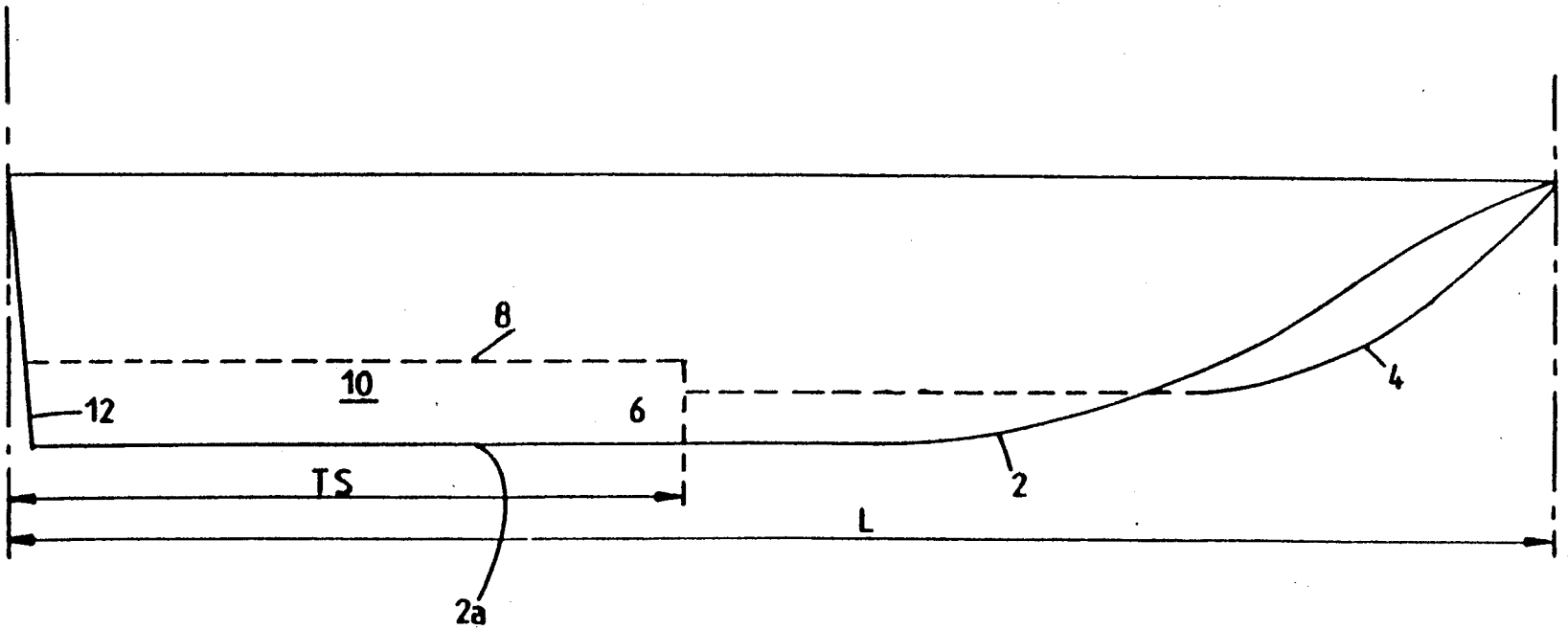
FIG. 2 is a schematic side view of the hull.
Figure 3:
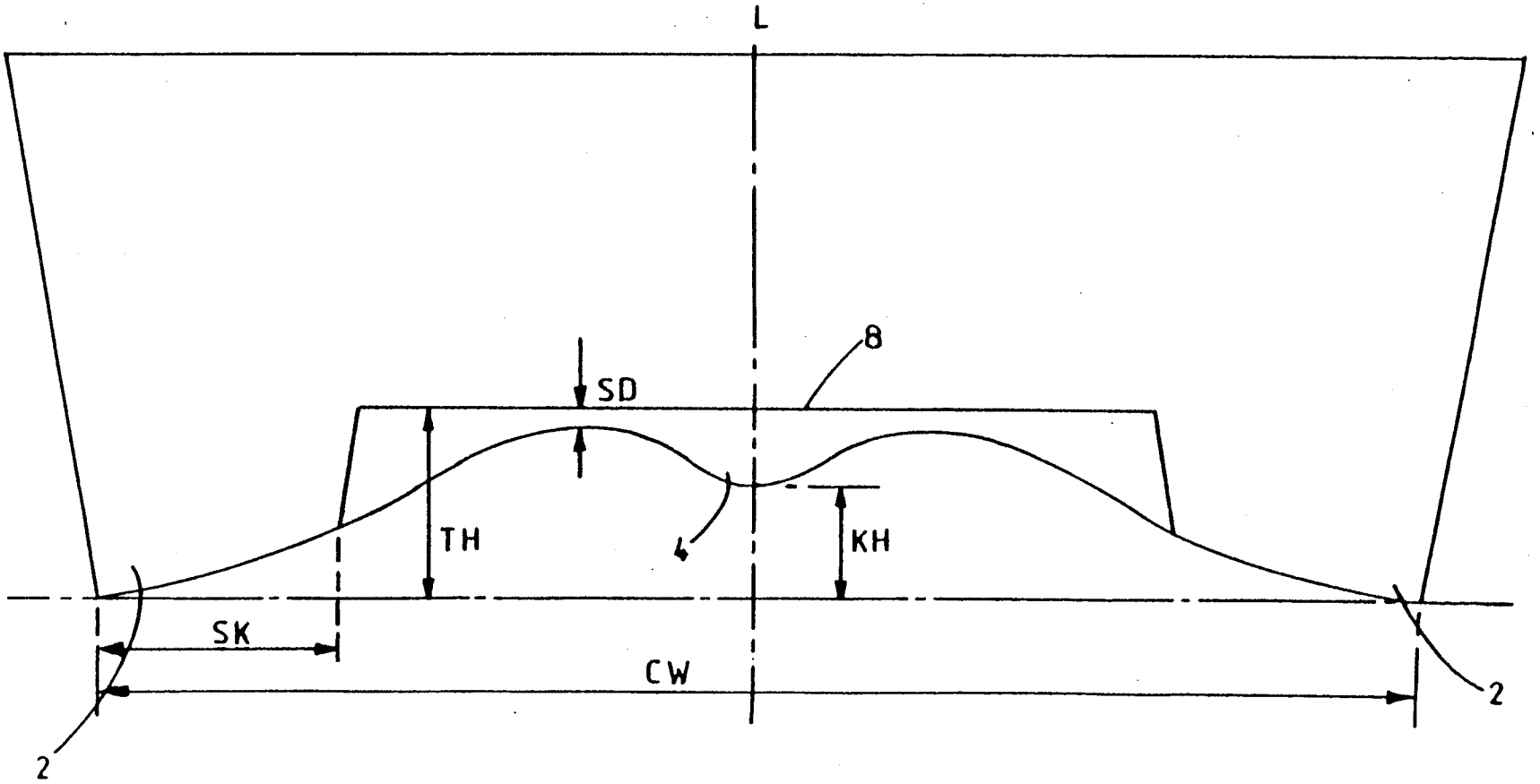
FIG. 3 is a schematic transverse section of the hull.

As shown in the drawings, the planing hull in accordance with the preferred embodiment comprises two side keels (2), and a central keel (4) which starts forwardly of the side keels (2) and which terminates at a transverse step (6) in the midships section of the hull. Rearwardly of the step (6), the central part of the underside of the hull is substantially planar to define the top surface (8) of a chamber or tunnel (10) open at its underside and flanked by the side keels (2) and open at its rear end. As is clearly shown in FIG. 2, the planar top surface (8) of the tunnel (10) is substantially parallel to the bottom edges or tips (2*a*) of the side keels (2). Whereas in the hull of patent specification 456,662, there is an aft centre keel within the pressure-retaining chamber or tunnel (10), it has now been determined that this is unnecessary and in the present embodiment, no such aft centre keel is present in the tunnel; this reduces the wetted surface area and reduces drag.

In the present embodiment, the step (6) does not incorporate air vents connected via ducts to an air intake system. Instead, all of the air supplied to the tunnel (10) to form the supporting air cushion is fed via the two passages defined at the underside of the hull between each side keel (2) and the centre keel (4). It has been determined that the absence of air vents in the step (6) provides improved entrapment of air in the tunnel leading to an improved cushioning effect which results in reduced drag at low to medium speeds. In this regard, it is believed that the vents in the step of the previously proposed hull, did, under certain conditions, particularly at low to medium speeds, permit loss of air pressure from the cushion and we have determined that an adequate supply of air can be achieved without these vents.

The side keels (2) are substantially wider than those of the previously proposed hull, and this provides a more efficient planing surface, and greater interior space within the hull for fitting propulsion machinery and other equipment. The side keel width and other significant dimensional relationships are indicated in Table I below. The Table indicates overall ranges for the relationships and the actual figures for a given hull will vary within these ranges according to such factors as specific cruising speed, payload and designated sea condition.

TABLE I

| | |
|---|---|
| Side keel width. | Range of SK/CW is 0.18 to 0.20 |
| Tunnel height. | Range of TH/CW is 0.14 to 0.16 |
| Transverse step depth. | Range of SD/TH is 0.03 to 0.10 |
| Forward centre keel height (at step). | Range of KH/TH is 0.55 to 0.65 |
| Transverse step (longitudinal position). | Range of TS/L is 0.45 to 0.46 |

The side keels each incorporate only two spray chines for the suppression of spray whilst the craft is in motion. The chines each consist of a strip (14) extending along the outer surface and inner surface of each side keel and result in only little drag and are of simple construction.

As mentioned earlier, the centre keel (4) begins forwardly of the side keels (2). This facilitates channelling of the air at the front of the boat for feeding to the tunnel (10). The forwardly extending centre keel (4) also softens the ride in choppy conditions as it will engage the wave crests prior to the side keels and will dampen the pitching effect.

The constant depth tunnel (10) enables trim tabs to be fitted at the back and which can be adjusted to set the bow angle to a desired inclination during planing.

The overall effect of the features described is to reduce the drag of the hull throughout the speed range. In comparison with the previously proposed hull as disclosed in Patent Specification 456,662, the hull described herein presents an average reduction of 20 to 25% at high and moderate-to-high speeds and up to 35% at lower speeds, particularly at the transition speed from the floating or displacement mode to the planing mode.

The embodiment has been described by way of example only and modifications are possible within the scope of the invention.

I claim:

1. A ground effect planing hull for a water craft, comprising two side keels and a centre keel therebetween, the centre keel terminating rearwardly at a transverse step defining a forward wall of a downwardly open pressure chamber flanked at each side by the side keels, said side keels each extending forwardly of said transverse step to define a pair of passages between said centre keel and said side keels, said transverse step extending laterally into said side keels and said passages terminating rearwardly at said transverse step, said chamber having a substantially planar upper wall and said chamber serving to confine a cushion of air which supports the hull in the planing mode, said step being imperforate whereby supply of air to the chamber is wholly via the underside of the hull by being channelled in said passages between the centre keel and the side keels.

2. A hull according to claim 1, wherein the chamber is of substantially constant depth along its length.

3. A hull according to claim 1, wherein each of said keels has a tip and the upper wall is substantially parallel to the tips of the side keels.

4. A hull according to claim 1, wherein the chamber is open at its rear end.

5. A hull according to claim 1, wherein the central keel starts forwardly of the side keels.

6. A hull according to claim 1, wherein the tips of the side keels are beneath the tip of the centre keel.

7. A hull according to claim 1, wherein the ratio of the width (SK) of each side keel to the breadth (CW) of the hull at the baseline of the hull is within the range of 0.18 to 0.20.

8. A hull according to claim 1, wherein ratio of the height (TH) of the top of the chamber above the baseline of the hull to the breadth (CW) of the hull at the baseline is within the range of 0.14 to 0.16.

9. A hull according to claim 1, wherein ratio of the height (TH) of the top of the chamber above the baseline to the height (KH) of the tip of the centre keel above the baseline at the aft end of the centre keel is from 0.55 to 0.65.

10. A hull according to claim 1, wherein the chamber commences substantially midway along the length of the hull.

11. A hull according to claim 10, wherein the ratio of the length (TS) of the chamber to the length (L) of the hull is from 0.45 to 0.46.

12. A hull according to claim 1, wherein the pressure chamber has a width substantially greater than the width of the centre keel.

* * * * *